US008419443B2

(12) United States Patent
Kamo

(10) Patent No.: US 8,419,443 B2
(45) Date of Patent: Apr. 16, 2013

(54) ELECTRIC CONNECTION BOX

(75) Inventor: Hiroaki Kamo, Kakegawa (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/158,488

(22) Filed: Jun. 13, 2011

(65) Prior Publication Data

US 2011/0306221 A1 Dec. 15, 2011

(30) Foreign Application Priority Data

Jun. 14, 2010 (JP) ..... 2010-134852

(51) Int. Cl.
*H01R 12/00* (2006.01)

(52) U.S. Cl.
USPC ..... 439/76.1

(58) Field of Classification Search ..... 439/76.1, 439/76.2, 79, 80, 621, 622, 682, 949, 723
See application file for complete search history.

(56) References Cited

U.S. PATENT DOCUMENTS 7,025,624 B2 * 4/2006 Kiyota et al. ..... 439/489
7,549,872 B2 * 6/2009 Akahori et al. ..... 439/76.2
7,670,184 B2 * 3/2010 Akahori et al. ..... 439/620.27

FOREIGN PATENT DOCUMENTS

JP 2001-211525 A 8/2001

* cited by examiner

*Primary Examiner* — Tulsidas C Patel
*Assistant Examiner* — Phuongchi Nguyen
(74) *Attorney, Agent, or Firm* — Edwards Wildman Palmer LLP

(57) ABSTRACT

For an object of providing an electric connection box which can relax limitation of arranging electric components and connectors of a wiring harness, the electric connection box includes a box main body having a plurality of cassette blocks in which a relay is mounted. A fusible link is mounted at one cassette block. A top surface of the one cassette block is arranged at a higher position than a top surface of the cassette block adjacent to the one cassette block. The plurality of cassette blocks is arranged to locate each of the top surfaces thereof lower one by one in proportion to parting from the one cassette block.

2 Claims, 4 Drawing Sheets

ELECTRIC CONNECTION BOX

The priority application Number Japan Patent Application 2010-134852 upon which this patent application is based is hereby incorporated by reference.

TECHNICAL FIELD

This invention relates to an electric connection box to be mounted at a car and the like as a moving body.

BACKGROUND ART

In a vehicle as a mobile body, various electronic apparatuses such as a lamp like a head lamp and a tail lamp, and a motor like a starter motor and a motor for an air conditioner are generally mounted.

For supplying electric power to the various electronic apparatuses, a junction block is arranged at a suitable position in the vehicle. The junction block is formed by integrating various electric circuit elements like many fuses and relays.

Since the junction box includes fuses, relays and bus bars, the junction box is called as a fuse block or a relay box or an electric connecting box generically. In the specification, an electric connection box (for example, shown in Patent Document 1) is a generic name for the fuse block, the relay box and junction block.

An electric connection box shown in Patent Document 1 includes a box main body forming an outer shell, a fusible link mounted at the box main body, a bus bar arranged in the box main body, an upper cover covering a top of the box main body and a lower cover covering bottom of the box main body. The box main body includes a frame-shaped main body and a plurality of cassette blocks received in the main body, as mount sections, in which electric components like the relays and the fuses are arranged. On a top surface of the cassette block, the above-mentioned electric components are arranged. A connector of a wiring harness connected to the various electronic apparatuses mounted at the vehicle is fitted at a bottom surface of the cassette block.

The fusible link includes a fuse circuit body and a housing. The fuse circuit body includes an electric power input portion, a plurality of output terminals and a fusible body connecting the electric power input portion and each of output terminals. Electric power from an electric power source such a battery or an electric power generator is supplied through the bus bar into the electric power input portion. Terminal joined with an end of an electric wire of the wiring harness is connected with the output terminal which is connected through the electric wire to the electronic apparatus. The fusible body is blown out to isolate electrically the electric power input portion and the output terminals when electric current more than a predetermined electric current value flows therethrough. When electric current less than the predetermined electric current value flows through the fusible body, the fusible body is not blown out so as to maintain electric connection between the electric power input portion and the output terminals, so that the electric power is supplied through the electric power input portion to the electronic apparatuses.

The housing is made of an electric insulation synthetic resin and includes a flat box-shaped housing main body and a transparent cover closing an opening of the housing main body. The housing main body receives remaining portion other than ends of the electric power input portion and the output terminals . The housing main body is provided with the opening to expose the fusible body. The transparent cover is made of transparent synthetic resin and formed into flat plate shape and arranged at the housing main body so as to close the opening. The transparent cover enables to determine visually from an outside whether or not the fusible body is blown out.

The fusible link structured above is mounted at one cassette block from the plurality of cassette blocks.

The bus bar is formed by punching a sheet metal and bending it, and arranged plurally. The plurality of bus bars is received in the cassette blocks. One of the plurality of bus bars is joined with an electric cable connected to the electric power source. The bus bars in the plurality of cassette blocks are connected to each other according to a predetermined connecting pattern. The bus bar in each cassette block connects the fusible links and each electric wire of the wiring harness according to the predetermined connecting pattern when electric components and fusible links to be mounted in the cassette blocks are mounted in the cassette blocks.

The above-mentioned electric connection box, to which the electric power from the electric power source is supplied through a power supply cable, distributes the electric power by the bus bars in the plurality of cassette blocks and through the electric wires of the wiring harness after flowing the fuses, relays and the fusible links toward various electronic apparatuses.

Citation List

Patent Document 1: Japan Patent Publication Application No. 2001-211525

SUMMARY OF INVENTION

Objects to be Solved

According to the usual electric connection box shown in the Patent Document 1, the fusible link should be arranged at an outer edge area of the fusible link so as to make securely visually recognizable whether or not each fusible body is blown out. Thereby, electric components such the fuse and the relay, and the connector of the wiring harness are limited to be arranged, so that a number of the cassette blocks may be increased.

For solving the above problem, an object of the present invention is to provide an electric connection box which can be improved about limitation of arrangement of electric components and connectors of a wiring.

How to Attain the Object of the Present Invention

In order to overcome the above problems and attain the object, the present invention is to provide an electric connection box including a box main body having a plurality of mount sections in which electric components are mounted, and a holding section arranged at the box main body so as to hold a fusible link; and a top surface of the holding section is arranged at a higher position than a top surface of the mount section adjacent to the holding section.

In the electric connection box according to the present invention, the top surface of each of the adjacent mount sections is arranged at respective positions which are located lower one by one in proportion to parting from the one of the plurality of mount sections, which holds the fusible link.

In the electric connection box according to the present invention, the top surface of the holding section, in which the fusible link is mounted, is arranged at the higher position than the top surface of the mount section adjacent to the holding section. Therefore, the fusible link is exposed when viewed from an upper position above the box main body.

In the electric connection box according to the present invention, each of the top surfaces of mount sections is positioned so as to be located lower one by one in proportion to parting from the holding section. Therefore, the fusible link is more securely exposed when viewed from an upper position above the box main body.

Effects of the Invention

According to the present invention, the fusible link is exposed when viewed from an upper position above the box main body, so that even if the fusible link to be mounted in the holding section is located at a central area of the box main body, the fusible link to be mounted in the holding section is securely exposed. Therefore, when the fusible link to be mounted in the holding section is arranged at the central area of the box main body, a fusible body of the fusible link can be visually recognized securely. A limitation that the fusible link should be arranged at an outer edge area of the box main body is eliminated, so that limitation about arranging electric components, such a fuse and a relay, and connectors of the wiring harness can be relaxed and increasing number of cassette blocks can be prevented.

According to the present invention, the fusible link is exposed securely when viewed from the upper position above the box main body, so that the limitation that the fusible link should be arranged at the outer edge area of the box main body is securely eliminated and limitation about arranging electric components, such a fuse and a relay, and connectors of the wiring harness can be relaxed.

DESCRIPTION OF EMBODIMENTS

Figure 1:
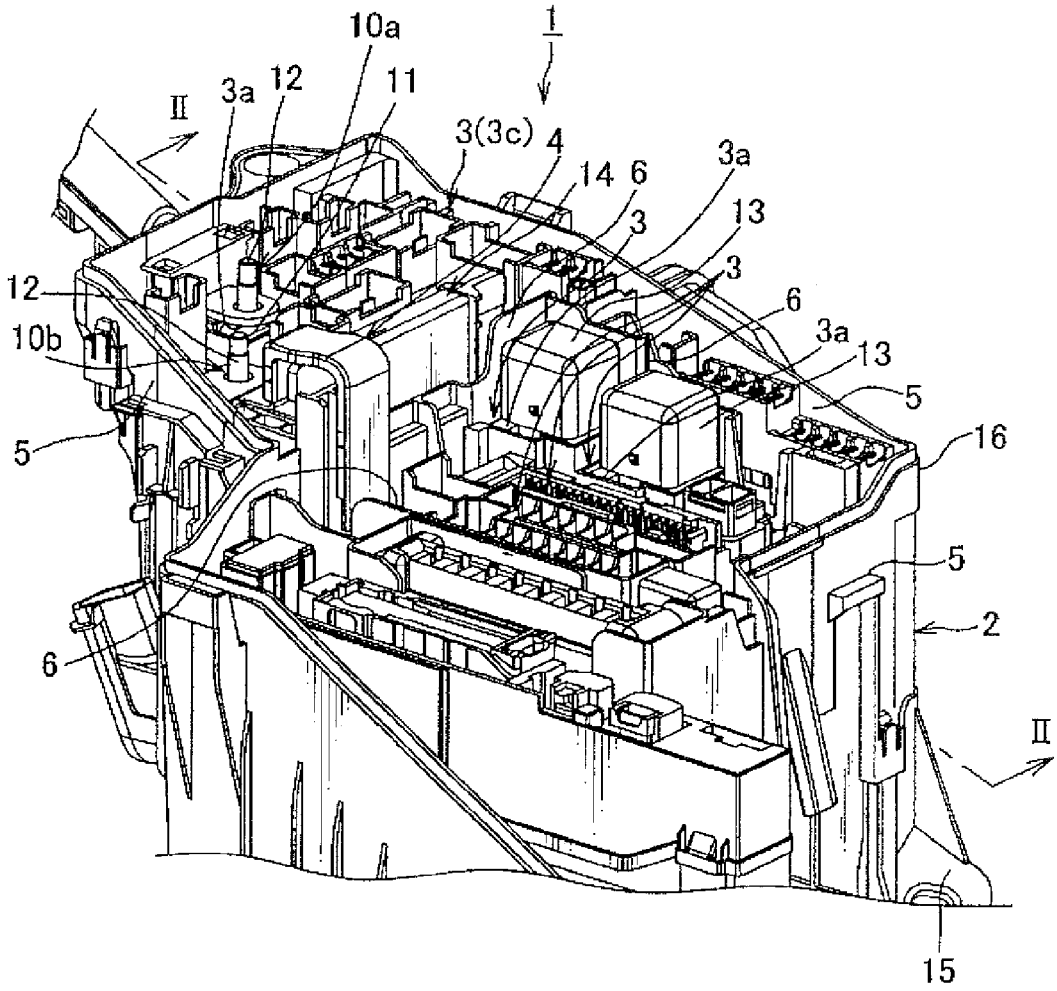
FIG. 1 is a perspective view of a main area of an electric connection box of an embodiment according to the present invention.

An electric connection box as an embodiment according to the present invention is described with reference to drawings FIGS. 1-6. The electric connection box 1 shown in FIG. 1 according to the embodiment is mounted at a vehicle as a moving body. The electric connection box 1 as shown in FIGS. 1 and 2 includes a box main body 2, a relay 13 and a fuse as a plurality of electric components, a not-shown bus bar arranged in the box main body 2, a connecting member 4, a fusible link 14 to be mounted at the box main body 2, a not-shown upper cover covering a top surface of the box main body 2 and a lower cover 15 covering a bottom surface of the box main body 2.

The box main body 2 includes a frame-shaped main body 16 and cassette blocks 3 as a plurality of mount sections to be received in the main body 16. The main body 16 is made of insulation synthetic resin and formed by injection molding. The main body 16 is formed into a tubular shape (frame shape) by a plurality of outer walls 5 which are continuous to each other. A space inside the box main body 2 is partitioned by a plurality of partition walls 6. A space surrounded by the plurality of outer walls 5 and the plurality of partition walls 6, which structure the box main body 2, opens at both ends of the space, which ends are located at upper and lower positions in FIGS. 1 and 2.

The cassette block 3 is formed into a box shape so as to be receivable in the space which is surrounded by the plurality of outer walls 5 and the plurality of partition walls 6. The cassette block 3 received in the space surrounded by the plurality of outer walls 5 and the plurality of partition walls 6 is mounted at the main body 16. At a top surface 3*a* of the cassette block 3 located at the upper position in FIGS. 1 and 2, electric components such as the relays 13 and the fuse. At a bottom surface 3*b* of the cassette block 3 located at the lower position in FIGS. 1 and 2, the connector of the wiring harness to be wired at the car is fitted. The electric wires, at end of which is joined with the connector of the wiring harness are connected with the various electronic apparatuses mounted at the car. The top surface 3*a* is a surface, at which the relays 13 and the fuses of the cassette block 3 are mounted. The bottom surface 3*b* is a surface, at which the connector of the wiring harness of the cassette block 3 is fitted.

Figure 2:
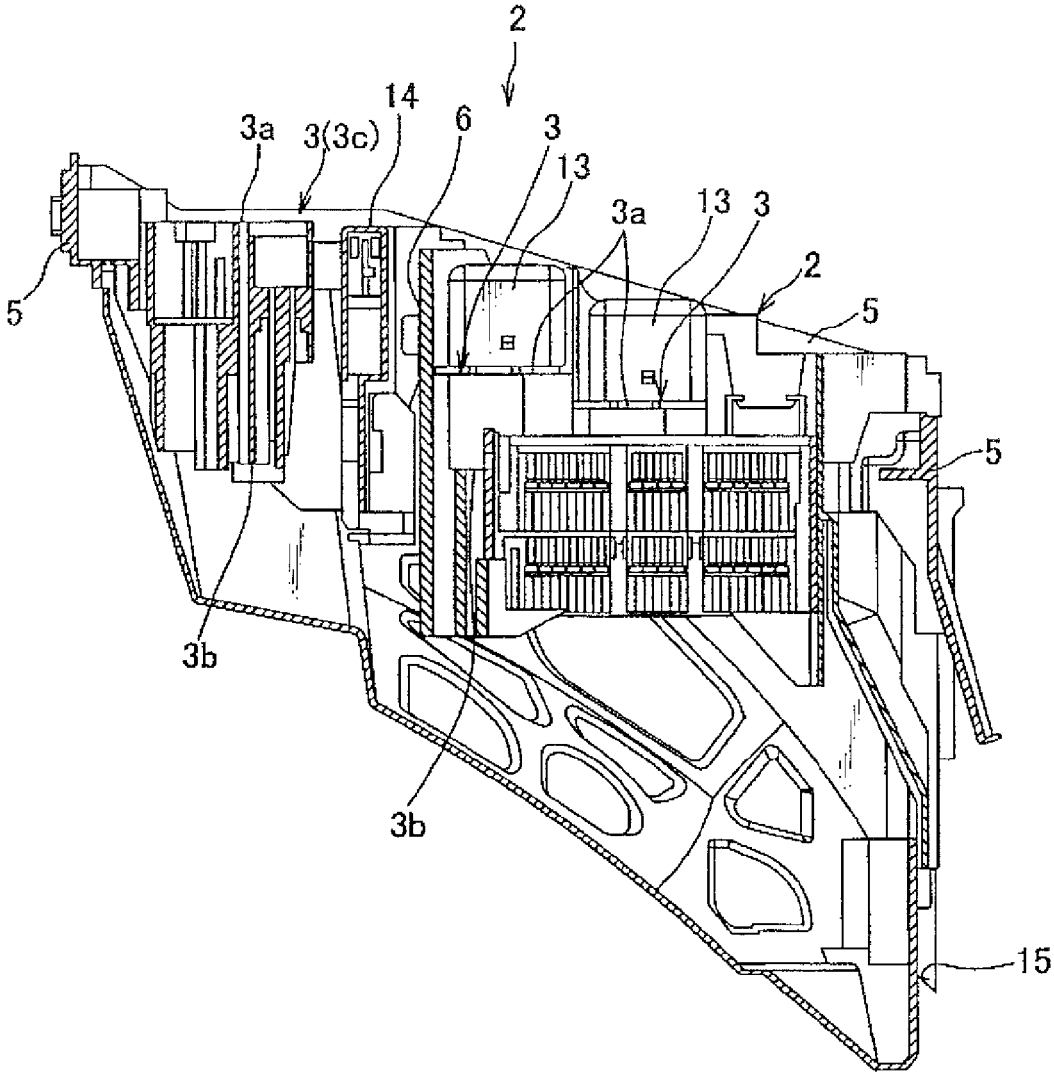
FIG. 2 is a cross-sectional view of the electric connection box taken along the line II-II shown in FIG. 1.

At the top surface 3*a* of one cassette block 3 (shown with 3*c* hereafter), which is positioned at most left side in FIG. 2 among the plurality of cassette blocks 3, a terminal block 10*a* for connecting with an electric power source such as a battery or an electric power generator and a terminal block 10*b* for connecting with the fusible link 14 are provided. When the one cassette block 3*c* is mounted at the box main body 2, the terminal block la is located in the vicinity of the outer edge of the box main body 2. When the one cassette block 3*c* is mounted at the box main body 2, the terminal block 10*b* is located close to the central area of the box main body 2.

Figure 4:
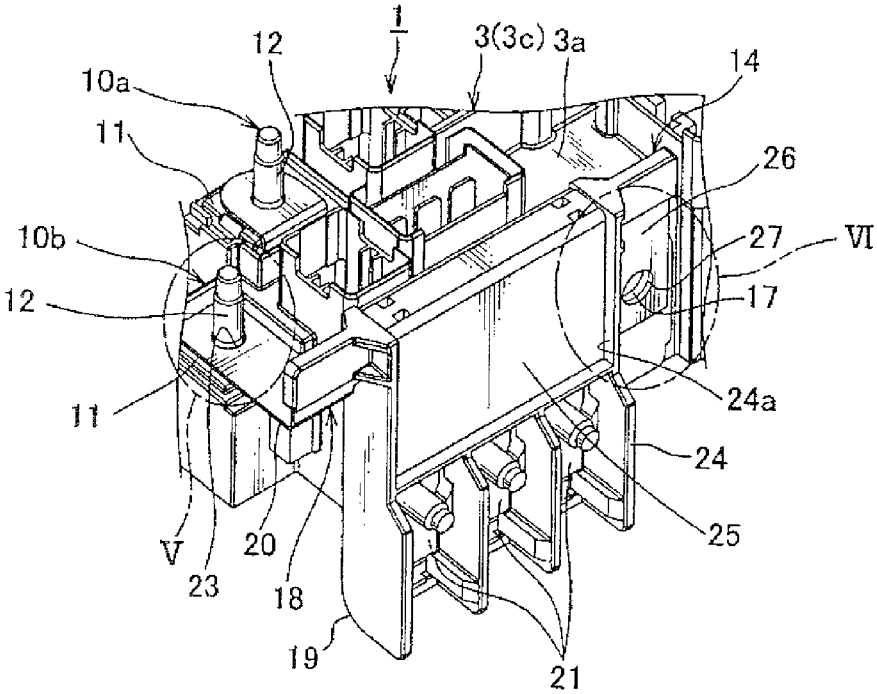
FIG. 4 is a perspective view of a condition of that the fusible link shown in FIG. 3 is mounted at one of cassette blocks.
Figure 5:
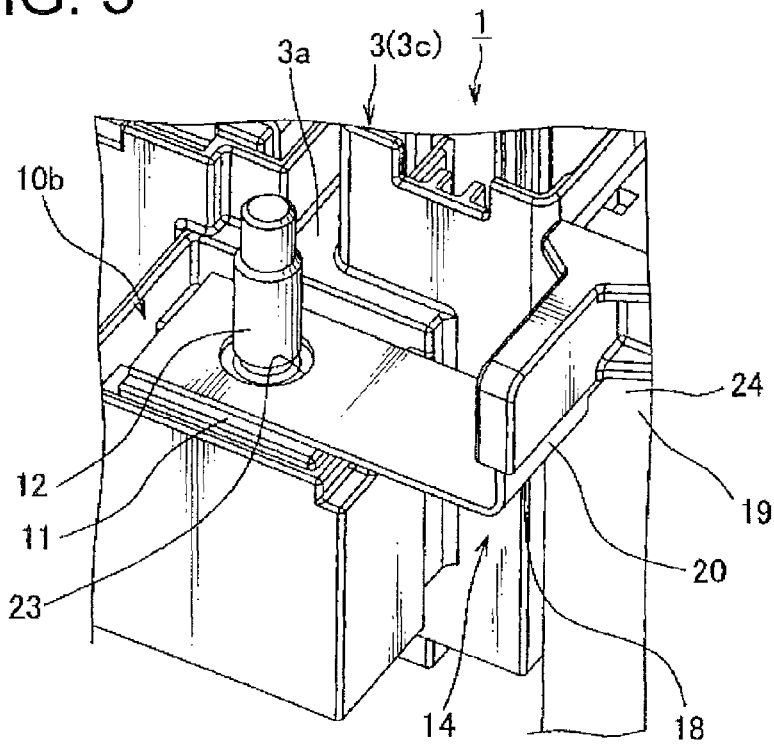
FIG. 5 is a partially expanded perspective view of an area V shown in FIG. 4.

Each of the terminal blocks 10*a*, 10*b* as shown in FIGS. 4 and 5 includes a base plate 11 continuous to a later-described bus bar and exposed at the top surface 3*a* of the cassette block 3*c*, and a screw shaft 12 extending vertically from the base plate 11. The base plate 11 is exposed at the top surface 3*a* of the cassette block 3*c* and the terminal blocks 10*a* and 10*b* are provided at the top surface 3*a* of the cassette block 3*c*. The base plate 11 is made of electric conductive metal. An outer peripheral surface of the screw shaft 12 is threaded.

The screw shaft 12 is inserted through a through hole of an electric contact portion of a terminal joined with an end of the electric power cable, which is connected to the electric power source, and the electric contact portion is placed on the terminal block 10*a* and the screw shaft 12 is screwed with a not-shown nut. Thereby, the terminal block 10*a* is connected with the electric power source.

Figure 6:
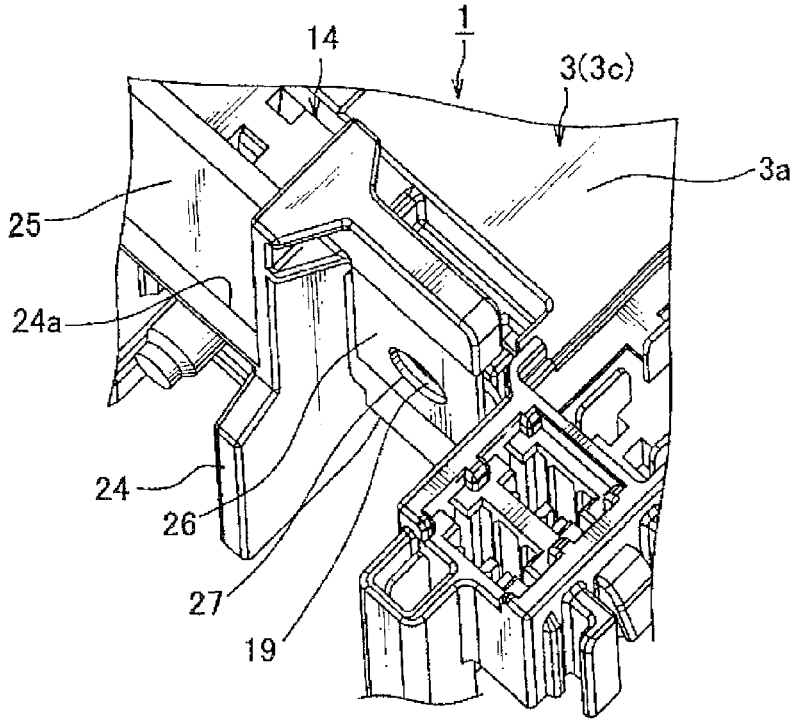
FIG. 6 is a partially expanded perspective view of an area VI shown in FIG. 4.

At a side surface of the one cassette block 3*c*, which side surface is closer to the central area, a bolt lock hole 17 for fixing the fusible link 14 as shown in FIGS. 4 and 6. The bolt lock hole 17 is opened at the above-mentioned side surface so as to communicate with a screw hole of the nut arranged in the one cassette block 3*c*. The one cassette block 3*c* corresponds to a holding section described in the present invention.

The one cassette block 3*c* is mounted, that is arranged, at the main body 16 of the box main body 2 so as to place the top surface 3*a* of the one cassette block 3*c* at a higher position than the top surface 3*a* of the other cassette block 3 adjacent to the one cassette block 3*c*. Each of the plurality cassette blocks 3 is mounted, that is arranged, at the main body 16 of the box main body 2 so as to locate each of top surfaces 3*a* respectively lower one by one in proportion to parting from the one cassette block 3*c*, as shown in FIG. 2.

The electric components such the relay 13 or the fuse are mounted at the top surfaces 3*a* of the cassette blocks 3, 3*c*. The bus bar formed by electric conductive metal sheet is arrange at each of cassette blocks 3 so as to connect electrically the terminals, that is electric wires, of the connector of the wiring harness to be fitted at the bottom surface 3*b* of the cassette block 3 and the electric components mounted at the top surface 3*a* according to a predetermined connecting pattern. The bus bar arranged in the one cassette block 3*c* connects electrically the base plates 11 of the terminal blocks 10*a*, 10*b*, the terminals, that is electric wires, of the connector of the wiring harness to be fitted at the bottom surface 3*b* of the cassette block 3 and the electric components mounted at the top surface 3*a* according to a predetermined connecting pattern. Only one of the connecting member 4 is shown in FIG. 1 and connects electrically and mechanically the bus bars of the cassette blocks 3, 3*c* adjacent to each other.

Figure 3:
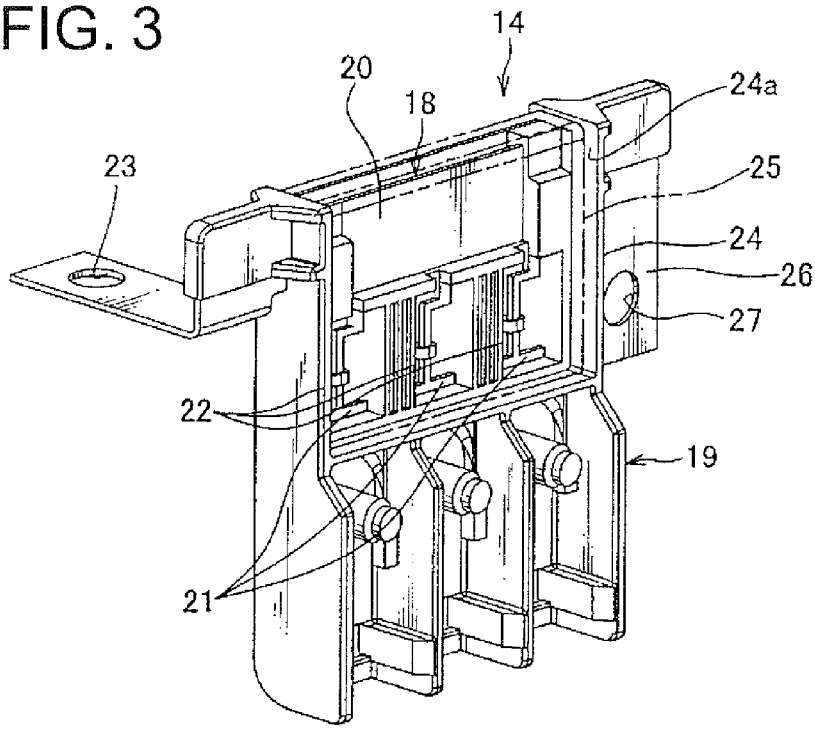
FIG. 3 is a perspective view of a fusible link of the electric connection box shown in FIG. 1.

The fusible link 14 as shown in FIG. 3 includes a fuse circuit body 18 and a housing 19. The fuse circuit body 18 includes an electric power input portion 20, a plurality of output terminals 21, a fusible body 22 connecting the electric power input portion 20 and each of the plurality of output terminals 21. At an end of the electric power input portion 20, a through hole 23, through which the screw shaft 12 of the terminal block 10*b* is inserted, is provided. As shown in FIGS. 4 and 5, the electric power input portion 20 is placed on the base plate 11 so as to insert the screw shaft 12 into the through hole 23, and the nut is screwed with the screw shaft 12, so that the electric power input portion 20 is mounted to the terminal block 10*b* so as to be clamped between the nut and the base plate 11 of the terminal block 10*b*. The electric power from the electric power source such the battery or the electric power generator is supplied through the terminal blocks 10*a*, 10*b* and the electric power cable to the electric power input portion 20.

The terminal joined with the end of the electric wires of the wiring harness is connected to the output terminals 21 so as to connect with the electronic apparatuses through the electric wires. The fusible body 22 is blown out to isolate electrically the electric power input portion 20 and the output terminals 21 when electric current more than a predetermined electric current value flows therethrough. When electric current less than the predetermined electric current value flows through the fusible body 22, the fusible body 22 is not blown out so as to maintain electric connection between the electric power input portion 20 and the output terminals 21, so that the electric power is supplied through the electric power input portion 20 to the electronic apparatuses.

The housing 19 is made of insulation synthetic resin and includes a flat box-shaped housing main body 24 and a transparent cover 25 covering an opening 24*a* of the housing main body 24. The housing main body 24 receives almost whole of the electric power input portion 20 and the output terminal and the fusible body 22 other than the end of the electric power input portion 20 of the fuse circuit body 18, at which the through hole 23 is provided, and ends of the output terminals 21. The housing main body 24 includes the opening 24*a* to expose the fusible body 22 to outside. The transparent cover 25 is made of transparent synthetic resin and formed into a flat plate shape, and mounted at the housing main body 24 so as to cover the opening 24*a*. The transparent cover 25 makes it visible to recognize blowing out of the fusible body 24 from outside. A fixing tab 26 corresponding to the bolt lock hole 17 is provided at the housing main body 24 of the housing 19. The fixing tab 26 is provided with a bolt through hole 27 to communicate with the bolt lock hole 17.

According to the fusible link 14 structured above, when the electric power input portion 20 is mounted at the terminal block 10*b* as mentioned above, the fixing tab 26 is overlapped on the bolt lock hole 17 as shown in FIGS. 4 and 6. A bolt is inserted through the bolt through hole 27 and screwed with a nut provided in the bolt lock hole 17. Thereby, the fixing tab 26 is held between a head of the bolt and a side surface of the one cassette block 3, so that the fixing tab 26 is locked at the one cassette block 3. Thus, the fusible link 14 structured above is mounted at the one cassette block 3.

The upper cover is made of insulation synthetic resin and mounted at the box main body 2 so as to cover the top surface of the box main body 2. The lower cover 15 is made of insulation synthetic resin and mounted at the box main body 2 so as to cover the bottom surface of the box main body 2.

The above-structured electric connection box 1 distributes the electric power supplied from the electric power cable through the relay, fuse and the fusible body 22 of the fusible link 14, and through the wiring harness to the various electronic apparatuses mounted at the car.

According to the embodiment, the top surface 3*a* of the one cassette block 3*c*, at which the fusible link 14 is mounted, is located at a higher position than the top surface 3*a* of the cassette block 3 adjacent to the one cassette block 3*c*, so that the fusible link 14 is exposed when viewed from the upper position above the box main body 2.

Therefore, even if the fusible link 14 to be mounted at the one cassette block 3*c* is located in the central area of the box main body 2, the fusible link 14 to be mounted at the one cassette block 3*c* is exposed. Thereby, even if the fusible link 14 to be mounted at the one cassette block 3*c* is located in the central area of the box main body 2, the fusible body 22 of the fusible link 14 can be securely recognized visually. Thus, the fusible link 14 need not be arranged at the outer area of the box main body 2, so that limitation about arranging electric components, such the fuse and the relay 13, and connectors of the wiring harness can be relaxed and increasing number of cassette blocks 3, 3*c* can be prevented.

Each of top surfaces 3*a* is located respectively lower one by one in proportion to parting from the one cassette block 3*c*, the fusible link 14 is exposed more securely when viewed from the upper position above the box main body 2. Thus, the fusible link 14 need not be arranged at the outer area of the box main body 2, so that limitation about arranging electric components, such the fuse and the relay 13, and connectors of the wiring harness can be more securely relaxed.

The present inventions are described based in the embodiments as mentioned above, but the present invention is not limited in above embodiments. Various change and modifications can be made with the scope of the present invention.

Remarks

1 Electric connection box
2 Box main body
3 Cassette block (mount section)
3*a* Top surface
3*c* One cassette block (mount section, hold section)
13 Relay (electric component)
14 Fusible link

The invention claimed is:

1. An electric connection box, comprising:

a box main body having a plurality of mount sections, in which electric components are mounted, wherein one of the plurality of mount sections holds a fusible link, wherein a top surface of the one of the plurality of mount sections, which holds the fusible link, is arranged at a higher position than a top surface of the mount section adjacent to the one of the plurality of mount sections, wherein the fusible link is held at a side wall of said one of the plurality of mount sections, and wherein the mount section adjacent to said one of the plurality of mount sections is arranged near the side wall, which the fusible link is held at.

2. The electric connection box according to claim 1, wherein the top surface of each of the mount sections adjacent is arranged at respective positions which are located lower one by one in proportion to parting from the one of the plurality of mount sections, which holds the fusible link.

* * * * *